US006725588B1

(12) United States Patent
Swoboda

(10) Patent No.: US 6,725,588 B1
(45) Date of Patent: Apr. 27, 2004

(54) POP-UP DISPLAY APPARATUS

(75) Inventor: Patti Swoboda, Fremont, NE (US)

(73) Assignee: C-Line Products, Inc., Mt. Prospect, IL (US)

( * ) Notice: Subject to any disclaimer, the term of this patent is extended or adjusted under 35 U.S.C. 154(b) by 0 days.

(21) Appl. No.: 10/187,926

(22) Filed: Jul. 2, 2002

(51) Int. Cl.[7] ..... G09F 1/00
(52) U.S. Cl. ..... 40/124.08; 281/38; 446/148
(58) Field of Search ..... 40/124.08; 281/38; 446/148; 218/38

(56) References Cited

U.S. PATENT DOCUMENTS 5,000,319 A 3/1991 Mermelstein
5,266,150 A 11/1993 Miller
5,933,989 A * 8/1999 Volkert et al. ..... 40/124.08
6,019,539 A 2/2000 Lynton

* cited by examiner

*Primary Examiner*—Cassandra H. Davis

(74) *Attorney, Agent, or Firm*—David C. Brezina; Barnes & Thornburg

(57) ABSTRACT

A pop-up display for mounting in a scrapbook or binder has folded tabs that are adhesively fastened to scrapbook or binder leaves is formed from a plastic sheet folded and bonded on two sides to form a pocket for an item such as a photograph, the tabs being aligned at an angle so that the display folds flat when the scrapbook or binder is closed and pops-up when opened.

19 Claims, 2 Drawing Sheets

POP-UP DISPLAY APPARATUS

BACKGROUND OF THE INVENTION

This invention relates to a foldable display apparatus mountable in a position spanning openable and closable leaves in a binder or scrapbook. The foldable apparatus provides a protective display that folds to a retracted position when the scrapbook is closed and the base leaves close to a position in parallel planes. In a deployed or extended position the apparatus "pops-up" to display an insert, such as a photograph 1. Field of the Invention The present invention relates to forming and mounting a display for inserts to span two flat surfaced leaves in a manner such that the display apparatus folds flat and opens to a substantially vertical position when the leaves are opened, using an adhesively attached, notched flange.

2. Description of Related Art

The related art includes various clear plastic sheet forming methods and the resulting products as well as a variety of adhesion methods and products. Additionally, various scrapbook products and techniques have been used to retain leaves in binders or books and techniques used to develop hand-made pop-up displays. None of these combine the efficient and easy to use features of the present invention in an economical and functional product that has the retrofittable standardized format that is aesthetically pleasing while leaving the archival attributes that protect the item displayed.

BRIEF DESCRIPTION OF THE PREFERRED EMBODIMENT

The Pop-Up Display Apparatus is designed to be a convenient and inexpensive method for mounting and displaying items in a binder or scrapbook. The preferred embodiment of this product consists of two clear plastic sheets laminated together to form a display pocket. At least one of the sheets extends to form a two part flange, the parts separated by a notch.

DETAILED DESCRIPTION OF THE PREFERRED EMBODIMENT

Figure 1:
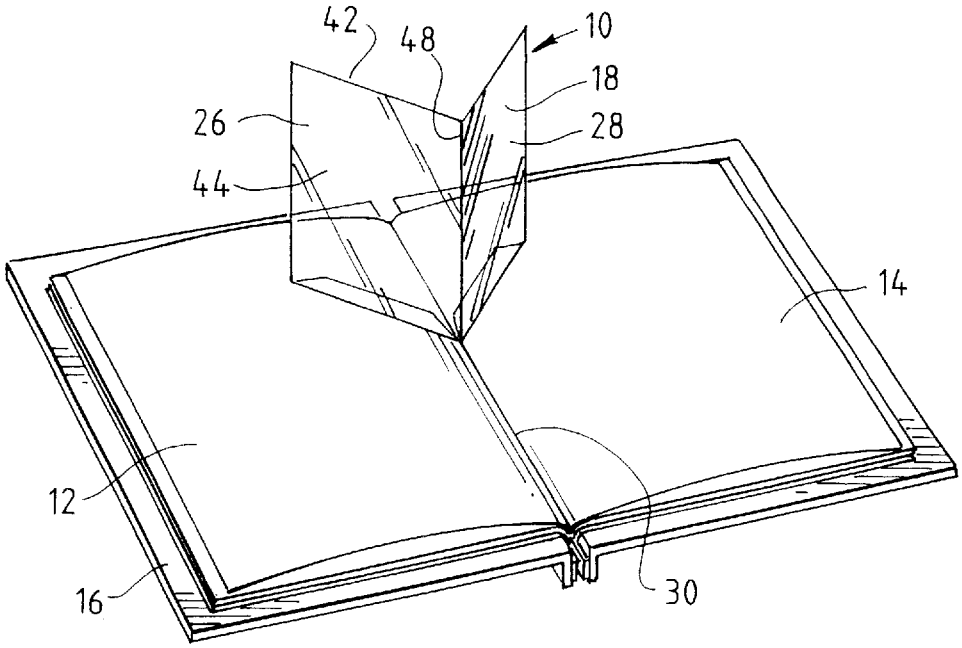
FIG. 1 is a perspective view of the Pop-Up Display Apparatus with the binder open.
Figure 2:
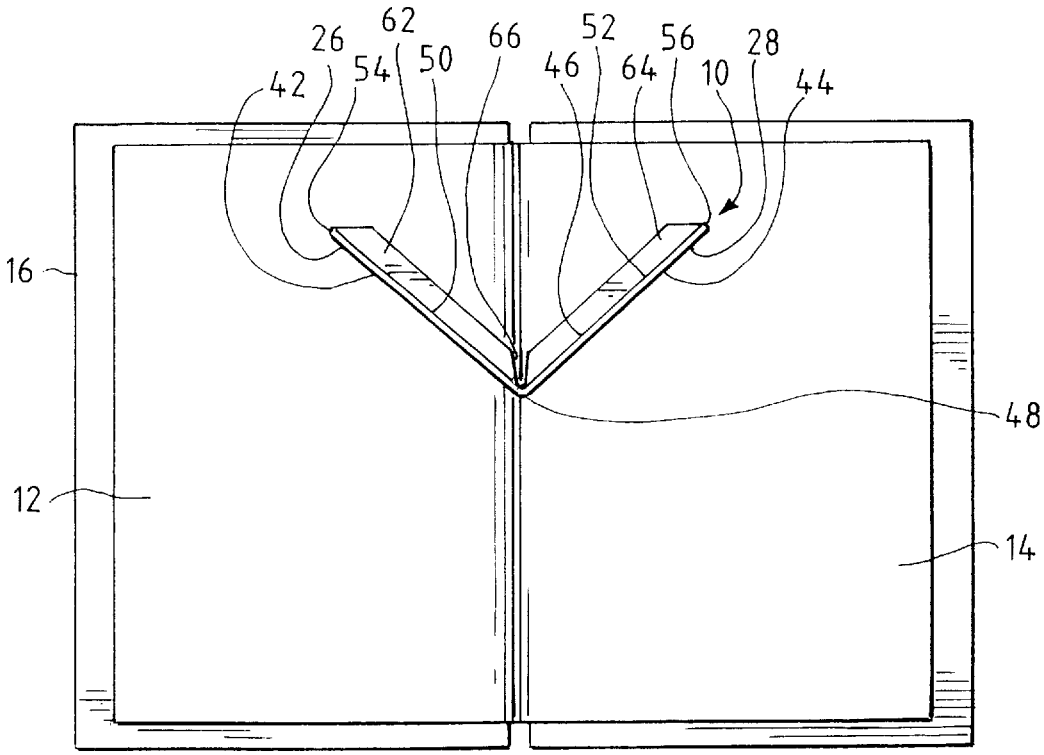
FIG. 2 is a top plan view of the Pop-Up Display apparatus.
Figure 3:
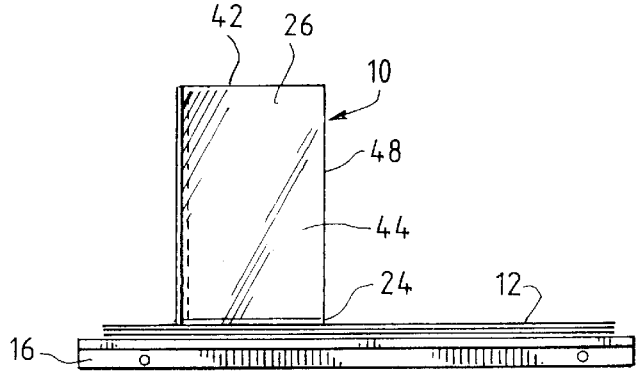
FIG. 3 is a side elevational view of the Pop-Up Display Apparatus.

For the purpose of promoting an understanding of the principles of the invention, references will be made to the embodiments illustrated in the drawings. It will, nevertheless, be understood that no limitation of the scope of the invention is thereby intended, such alterations and further modifications in the illustrated device, and such further applications of the principles of the invention illustrated herein being contemplated as would normally occur to one skilled in the art to which the invention relates.

A foldable pop-up display 10 is mountable in a position spanning openable and closable leaves 12, 14 in a binder or scrapbook 16. The terms "binder" and "scrapbook" are to be considered interchangeable, and although the preferred use for the invention is for a scrapbook, the invention is not limited to use in scrapbooks. The foldable pop-up display 10 provides a pocket 18 that receives an item 20 for purposes of display. The foldable pop-up display 10 opens, as shown in FIG. 1, but folds to a retracted position 22 when the scrapbook 16 is closed and the base leaves 12, 14 close to a position in parallel planes. In a deployed or extended position 24 the pop-up display 10 "pops-up" to display the insert or item 20, such as a photograph Pop-up display 10 provides a display for inserts 20 by opening and closing as a result of its position to span the two flat surfaced leaves 12, 14 such that the display pop-up display 10 folds flat when leaves 12, 14 are in parallel planes when the binder or scrapbook 16 is closed. Because the faces 26, 28 of pop-up display 10 are obliquely angled relative to one another, and relative to the centerline 30 between leaves 12, 14, the operation of opening binder or scrapbook 16 so that leaves 12, 14 approach a coplanar relationship, raises left and right faces 26, 28 to a substantially vertical position.

Pop-up display 10 is preferably formed of a plastic sheet material, such as polypropylene, polyvinyl chloride or polyethylene. All these materials are familiar in the scrapbook and sheet protector field, and each has certain advantages and disadvantages in cost, durability, optical and chemical properties. Polypropylene sheet is often thought to be superior for archival purposes, as it (or its constituents) do not chemically react with chemicals on photographs or toner on photocopies or laser printed pages.

Pop-up display 10 can be formed from a single sheet, or multiple bonded or welded sheets. A single sheet is preferred as existing manufacturing can be adapted to fold, weld and cut as described herein. In the preferred embodiment, the sheet 40 has a top fold 42 that defines front 44 and rear 46 layers. However, a seam attaching separate sheets and forming a top edge in the position of fold 42 could also be used.

Front layer 44 is subdivided into left and right faces 26, 28 by center fold 48. Center fold 48 also divides rear layer 46 into left and right back portions 50, 52. Perpendicular to top fold 42 are left and right edges 54, 56. At the bottom of faces 26, 28 are left and right tab folds 58, 60 which connect left and right tabs 62, 64 to faces 26, 28. Folds 58, 60 act as hinges between faces 26, 28 and tabs 62, 64. Tabs 62, 64 are fixed to leaves 12, 14 such as by adhesive, in the orientation described above, so as to render the pop-up display 10 operable.

Tabs 62, 64 are separated by notch 66 aligned with center fold 48 and notched at an angle such that the preferred mounting angle when the leaves are opened, is achieved by closing the notch so that the notch edges are substantially parallel.

Figure 4:
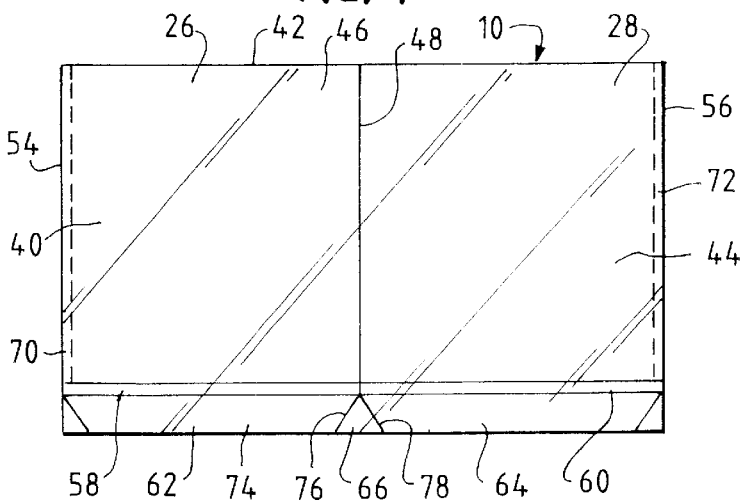
FIG. 4 is a top view of the Pop-Up Display Apparatus in an unmounted condition.
Figure 6:
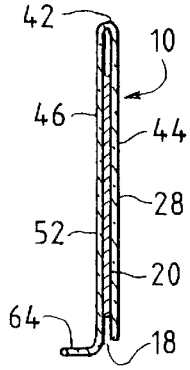
FIG. 6 is a sectional view of the display pocket.
Figure 5:
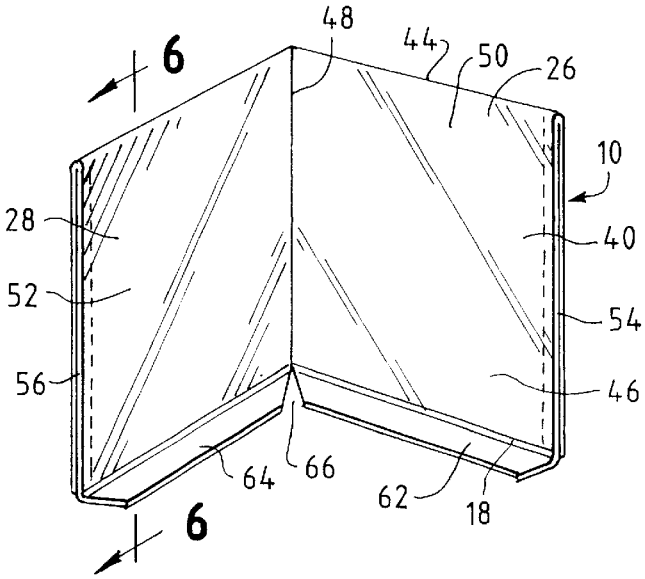
FIG. 5 is a perspective view of the Pop-Up Display Apparatus from the reverse.
Figure 7:
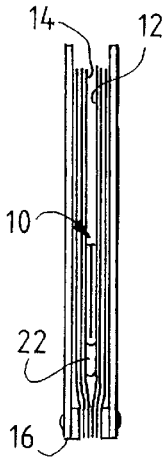
FIG. 7 is a top elevational view of a closed binder with the Pop-Up Display Apparatus folded.

It will be noted that the preferred embodiment, as illustrated in FIG. 4 forms the flat display 10 from a single sheet 40 with the top fold 42 formed to define the front 44 and rear 46 layers. As contemplated, proximate left and right edges 54, 56 will be welds or bonds 70, 72 to close the top and two sides to define pocket 18. Overlap of rear layer 46 over front layer 44 will define flange 74. Flange 74 has two legs 76, 78 formed as a part of a seal bar that will enable the consumer to cut notch 66. Alternatively and in addition these will provide reinforcement and ease of use for the consumer in the event a factory cut notch 66 is made, such as by a subsequent die-cutting operation. Legs 76, 78 are preferably at 100 degrees from one another. Center fold line 48 can be manually formed by the end user, using the apex of legs 76, 78 as a guide and folding by aligning the top comers where edges 54, 56 intersect with top fold 42.

While the present invention has been disclosed and described with reference to a single embodiment thereof, it will be apparent, as noted above that variations and modifications may be made therein. It is also noted that the present invention is independent of the item being displayed, and is not limited to the a particular item. It is intended in the following claims to cover each variation and modification that falls within the true spirit and scope of the present invention.

What is claimed is:

1. A display for an item comprising:

a transparent plastic sheet formed to define a top fold and first and second layers;

said first layer is subdivided into left and right faces by a center fold;

said second layer is subdivided into left and right back portions by said center fold;

each of said first and second layers having left and right edges and being joined at said edges to define a pocket between said layers;

said first layer having a bottom edge defining a pocket entrance;

said second layer having a bottom portion merging into a hinge portion;

said hinge portion connecting said bottom portion to a flange;

said flange being formed such that said display is foldably mountable to leaves in a binder so that the display is folded closed when the leaves are closed and said display deploys when the leaves are opened.

2. The display of claim 1 and:

at the bottom of said left and right faces said hinge is formed by left and right tab folds;

said flange is subdivided into left and right tabs;

said flange folds connect left and right tabs to said left and right faces;

said tabs are affixable to leaves of a binder by an adhesive.

3. The display of claim 2 and:

said tabs are separated by notch portion aligned with said center fold;

said notch portion being formed to define an angle defining the boundaries for a notch aligned such that the preferred mounting angle when the leaves are opened, is achieved by closing said notch.

4. The display of claim 3 and:

said display is formed from a single sheet with said left and right edges being welded to close two sides to define said pocket.

5. The display of claim 4 and:

said first layer overlaps said second layer to defines said flange.

6. The display of claim 5 and:

said flange having two legs formed as a part of a seal bar to align said notch;

said legs are formed at a greater than 90 degree angle from one another.

7. A display apparatus mountable to base leaves in a binder that can be opened and closed, comprising:

a foldable pocket adapted to be mounted in a position spanning the openable and closable base leaves:

said pocket folds to a retracted position when the binder is closed and the base leaves close to a position in parallel planes and in a deployed position said foldable pocket pops-up to a substantially perpendicular position relative to the position of the leaves;

said pocket is formed from a transparent plastic sheet further having a top fold and first and second layers bonded together at edges and a bottom;

said pocket has a pocket entrance at its bottom;

said pocket has a hinge portion connecting a flange to said bottom;

said flange is formed so that said display is foldably mountable to leaves in a binder so that the display is folded closed when the leaves are closed and said display deploys when the leaves are opened.

8. The display of claim 7, and:

a hinge connects said flange to said bottom;

said flange is subdivided into left and right tabs;

said tabs are affixable to the leaves of the binder by an adhesive.

9. The display of claim 8, and:

said tabs are separated by notch portion;

said notch portion defines an angle which sets the boundaries for a notch aligned such that the preferred mounting angle when the leaves are opened, is achieved by closing said notch.

10. The display of claim 9, and:

said display is formed from a single sheet folded into said first and second layers, with said edges being welded to close two sides to define said pocket.

11. The display of claim 10 and:

said first layer overlaps said second layer to defines said flange.

12. The display of claim 9, and:

said flange has two legs formed as a part of a seal bar to align said notch;

said legs are formed at a greater than 90 degree angle from one another.

13. The display of claim 12, wherein said notch is to be formed by a user.

14. The display of claim 12, wherein said notch is formed between said legs of said display.

15. A display for an item comprising:

a transparent plastic sheet formed to define a top fold and first and second layers;

each of said first and second layers having left and right edges and being joined at said edges to define a pocket between said layers;

said first layer having a bottom edge defining a pocket entrance;

said second layer having a bottom portion merging into a hinge portion;

said hinge portion connecting said bottom portion to a flange;

said flange being formed such that said display is foldably mountable to leaves in a binder so that the display is folded closed when the leaves are closed and said display deploys when the leaves are opened.

16. The display of claim 15 and:

said hinge portion is formed by left and right tab folds;

said flange is subdivided into left and right tabs;

said flange folds connecting said left and right tabs to said leaves;

said tabs are affixable to said leaves of a binder by an adhesive.

17. The display of claim 16 and:

said tabs are separated by a notch portion aligned between said edges;

said notch portion being formed to define an angle defining the boundaries for a notch aligned such that the preferred mounting angle when the leaves are opened, is achieved by closing said notch.

18. The display of claim 17 and:

said display is formed from a single sheet with said left and right edges being welded to close two sides to define said pocket and the overlap of said first layer over said second layer defines said flange.

19. The display of claim 18 and:

said flange has two legs formed as a part of a seal bar to align said notch;

said legs are formed at a greater than 90 degree angle from one another.

* * * * *